United States Patent [19]

Ueno et al.

[11] Patent Number: 4,639,663

[45] Date of Patent: Jan. 27, 1987

[54] FLY-BACK TRANSFORMER WITH REDUCED RINGING

[75] Inventors: Michio Ueno, Kyoto; Toshimi Miyagi, Kusatsu; Soji Yamaguchi, Yokohama, all of Japan

[73] Assignee: Murata Manufacturing Co., Ltd., Japan

[21] Appl. No.: 821,054

[22] Filed: Jan. 21, 1986

[30] Foreign Application Priority Data

Jan. 23, 1985 [JP] Japan ..... 60-11560

[51] Int. Cl.[4] ..... H01F 27/42

[52] U.S. Cl. ..... 323/356; 363/39

[58] Field of Search ..... 323/356; 336/180; 363/21, 39, 40

[56] References Cited

U.S. PATENT DOCUMENTS 4,073,003 2/1978 Chambers ..... 363/21

4,227,143 10/1980 Elders et al. ..... 336/180

4,355,353 10/1982 Farrer ..... 363/21

4,466,051 8/1984 Fitzgerald ..... 363/21

4,524,411 6/1985 Willis ..... 363/21

*Primary Examiner*—Mark O. Budd

*Assistant Examiner*—Jeffrey Sterrett

*Attorney, Agent, or Firm*—Ostrolenk, Faber, Gerb & Soffen

[57] ABSTRACT

A fly-back transformer to be used for use in the supply of a DC high voltage into a cathode-ray tube such as TV image receiving machine or the like. The ringing removing wire connected with the secondary winding through the distributed capacity with respect to the secondary winding to form a closed circuit of ringing current together with the secondary winding is connected in parallel to the primary winding through the DC resistance component, so that the ringing may be damped by the closed circuit.

3 Claims, 9 Drawing Figures

FLY-BACK TRANSFORMER WITH REDUCED RINGING

BACKGROUND OF THE INVENTION

The present invention relates to a fly-back transformer for use in the supply of a DC high voltage into a cathode-ray tube such as TV image receiving machine or the like, and more particularly, to a fly-back transformer, which is adapted to reduce higher harmonic ringing to be caused in the secondary winding during the scanning period of a horizontal deflecting circuit.

As to a general construction of conventional fly-back transformer, FIG. 1 is an electric circuit diagram of a high-tension output circuit having a flay-back transformer connected with the horizontal deflecting circuit. A horizontal output transistor 1, a damper diode 2, a resonance capacitor 3, a horizontal deflecting coil 4, and an S-shape correcting capacitor 5 are disposed in the electronic circuit diagram. A fly-back transformer 6 has a primary winding 61 and a plurality of secondary windings 62, 63, 64 and 65 therein. Diodes 71, 72, 73 and 74 are alternately connected with the secondary windings. A high tension output terminal 81 and an earth terminal 82 are disposed in the fly-back transformer.

Normally, such a fly-back transformer 6 as described hereinabove has the primary-winding-wound low-tension bobbin engaged with a closed magnetic path core composed of a pair of ⊐-shaped cores butted, further has a split type high-tension bobbin engaged therewith, the split type high-tension bobbin having many grooves with a plurality of secondary windings 62, 63, 64 and 65 alternately connected to the diodes 71, 72, 73 and 74 being wound into them. These windings are accommodated within an insulated case and are resin-molded.

A shot-pulse 9 is caused during a fly-back period of a horizontal deflecting circuit, as shown in FIG. 2, in the secondary windings of the fly-back transformer constructed as described hereinabove, and the ringing 10 is caused during the scanning period. As the ringing 10 during this scanning period deteriorates the picture quality by vertical stripes caused on the TV picture face of, for example, a TV image receiving machine, it is required to be made as little as possible. The ringing 10 is caused by a series resonance circuit made by the leakage inductance and the distributed capacity with respect to the primary winding 61 of the secondary windings 62, 63, 64 and 65. Although the fly-back transformer is desired to be constructed to reduce the leakage inductance and the distributed capacity in order to make such ringing 10 smaller to prevent the picture-quality deterioration, there is a restriction point to such construction as described hereinabove. Accordingly, the electric characteristics was conventionally improved through the so-called high harmonic tuning of tuning the series resonance circuit of the leakage inductance and the distributed capacity with respect to the primary of the secondary windings to the odd times of the basic pulse frequency to be inputted to the primary winding.

However, even if such an improvement measure was taken, the improvement in the electric characteristics of the picture-quality deterioration was restricted.

SUMMARY OF THE INVENTION

Accordingly, an object of the present invention is to provide a fly-back transformer, which is adapted to sufficiently reduce the ringing through extremely simple construction to improve the picture quality.

In accomplishing this object according to the present invention, there is provided an improved fly-back transformer, wherein a primary winding and a secondary winding are provided, a ringing removing winding which is connected with the secondary winding through the distributed capacity with respect to the secondary winding to form a closed circuit of the ringing current together with the secondary winding is connected in parallel to the primary winding through the DC resistance component, the primary winding and the ringing removing winding satisfy a relation formula of $0.85 \leqq M/L1 \leqq 1$, wherein L1 is the inductance of the primary winding, M is the mutual inductance between the primary winding and the ringing removing winding, the impedance between the primary winding and the secondary winding has a value larger with respect to the frequency of the ringing current than a value of the DC resistance component added to the impedance between the ringing removing winding and the secondary winding.

BRIEF DESCRIPTION OF THE DRAWINGS

This and other objects and features of the present invention will become apparent from the following description taken in conjunction with the preferred embodiments thereof with reference to the accompanying drawings, in which.

DETAILED DESCRIPTION OF THE INVENTION

Figure 1:
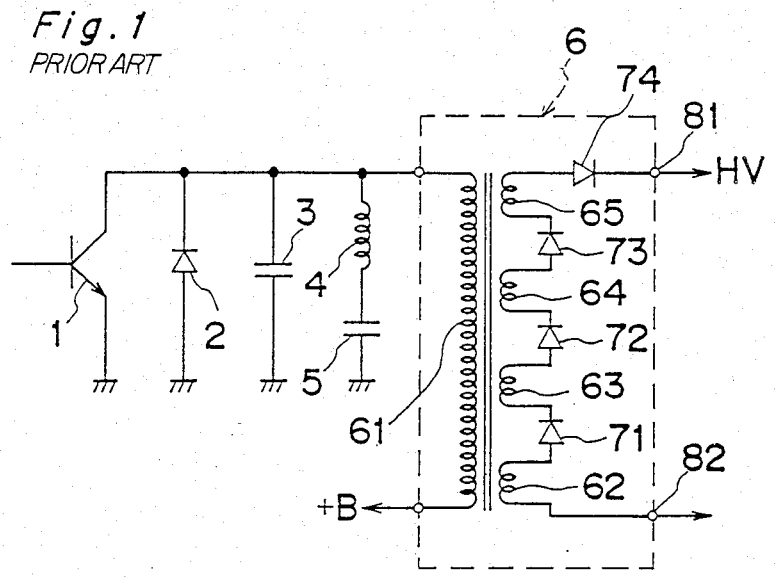
Fig. 1 PRIOR ART
FIG. 1 is a high-tension output circuit diagram including a fly-back transformer.

Before the description of the present invention proceeds, it is to be noted that like parts are designated by like reference numerals throughout the accompanying drawings.

Figure 3:
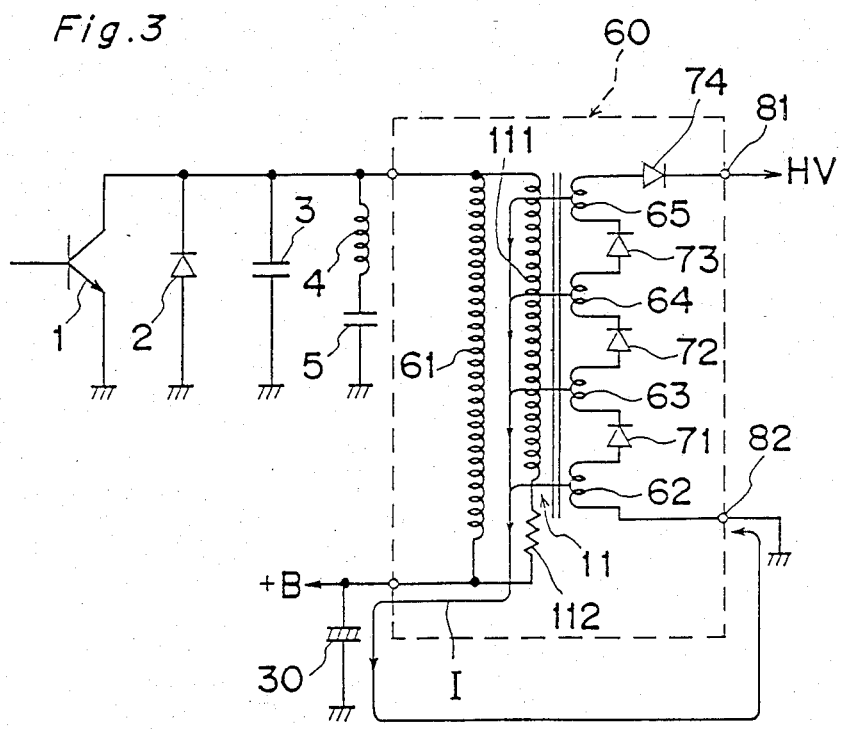
FIG. 3 is a high-tension output circuit diagram including a fly-back transformer in accordance with the embodiment of the present invention.
Figure 2:
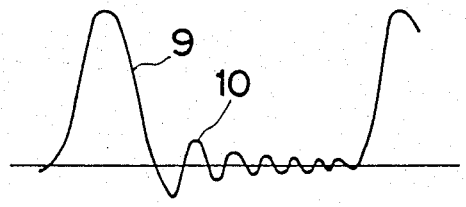
Fig.2 PRIOR ART
FIG. 2 is a chart of voltage waveform to be caused in the secondary winding for use in the description of the ringing.

Referring now to the drawings, there is shown in FIG. 3 a high-tension output circuit diagram which includes a fly-back transformer. A horizontal output transistor 1, a damper diode 2, a resonance capacitor 3, a horizontal deflection coil 4, and a capacitor 5 for correcting S shape are shown in FIG. 3. The fly-back transformer 60 has a primary winding 61 and a plurality of secondary windings 62, 63, 64 and 65. Diodes 71, 72, 73 and 74 are alternately connected with the secondary windings. A high-tension output terminal 81 is connected with the anode of a cathode-ray tube, an earth terminal 82 is connected through an ABL circuit or in direct relation with the earth. It is to be noted that focusing voltage is drawn out from the side of the cathode of a predetermined diode, for example, the diode 71 if necessary. Such construction as described hereinabove is similar to that of FIG. 1.

The embodiment of the present invention has characteristics in the following construction.

Namely, the fly-back transformer 60 in this embodiment is provided with a series circuit of a ringing removing winding 111 and a resistance element 112 connected in parallel to the primary winding 61. The ringing removing winding 111 is also disposed opposite to the secondary windings 62, 63, 64 and 65 to combine the secondary windings 62, 63, 64 and 65 through the distributed capacity with respect to the secondary windings 62, 63, 64 and 65 to form a closed circuit 11 of the ringing current I, together with a smoothing capacitor 30 of a DC power (+B) to be fed to the resistance element 112 and the primary winding 61.

The primary winding 61 and the ringing removing winding 111 satisfies a relation formula of $$0.85 \leqq M/L1 \leqq 1$$

wherein L1 is the inductance of the primary winding 61, M is the mutual inductance between the primary winding 61 and the ringing removing winding 111.

The relation formula will be described. The following formulas (1) and (2) become $$L1di1/dt+Mdi2/dt=E \quad (1)$$

$$L2di2/dt+Ri2+Mdi1/dt=E \quad (2)$$

wherein L2 is the inductance of the ringing removing winding 111, R is the resistance value of the resistance element 112, i1 and i2 are basic pulse currents by the basic pulses flowing into each of the windings 61 and 111, k is the coupling coefficient of both windings 61 and 111 through mutual induction, a power-supply voltage E(+B) is transiently given to those circuits.

If Laplace transform is performed upon each of the formulas (1) and (2) and a known calculation processing such as rendering the initial value becomes zero, the following formula (3) becomes $$i2(t)=K\{1-(M/L1)\} \quad (3)$$

wherein K is a value including E, R, t, k, L2. As apparent from formula (3), get the 1−(M/L1) close to 0 and the current i2 flowing to the ringing removing winding 111 becomes smaller. Thus, most of the basic pulse current to be inputted to the primary winding 61 is adapted to flow into the primary winding 61 to reduce as much as possible the loss of the basic pulse current in the ringing removing winding 111. In this case, it has been confirmed that M/L1 is 0.85 or more and a value of 1 or lower may most effectively reduce the loss of the basic pulse current in the ringing removing winding 111.

Then, in this embodiment, the impedance between the primary winding 61 and the secondary windings 62, 63, 64 and 65 has a value larger with respect to the frequency of the ringing current than a value, which is the resistance value of the resistance element 112 added to the impedance between the ringing removing winding 111 and the secondary windings 62, 63, 64 and 65. Most of the ringing current I is adapted to flow through the closed circuit including the ringing removing winding 111 and the resistance element 112 as shown in an arrow of FIG. 3 because of such impedance relation as described hereinabove.

Figure 7:
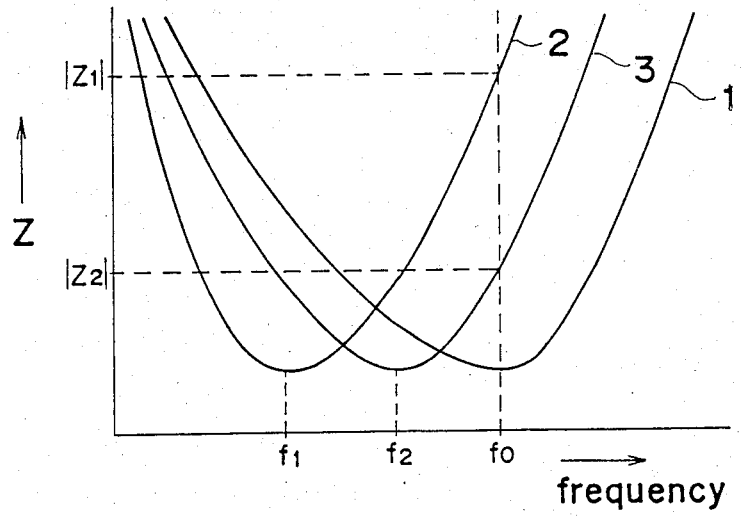
FIG. 7 is a characteristic curve chart for illustrating the characteristics of the series resonance frequency between the primary winding, with respect to the secondary windings in each of the fly-back transformers and the ringing removing winding.

This fact will be described hereinafter. Now assume that the ringing current I flows even into the primary winding 61. Assume that a ringing current flowing into the primary winding 61 is I'. In this case, although the ringing removing winding 111 and the resistance element 112 are connected in parallel with the primary winding 61, the resistance value of the resistance element 112 is assumed to be 0. The primary winding 61 and the ringing removing winding 111 form a series of resonance circuit among the secondary windings 62, 63, 64 and 65, the series resonance characteristics of the series resonance circuit become a curve 1 of FIG. 7. And the series resonance frequence is f0. The frequency of the ringing currents I and I' becomes the series resonance frequency f0. Referring to FIG. 7, the curve 2 is a series resonance characteristic curve among the secondary windings 62, 63, 64 and 65 and the primary winding 61, the curve 3 is a series resonance characteristic curve among the secondary windings 62, 63, 64 and 65 and the ringing removing winding 111. However, in FIG. 7, the abscissa shows the frequency, while the ordinate |Z| shows the series resonance impedance.

Figure 8:
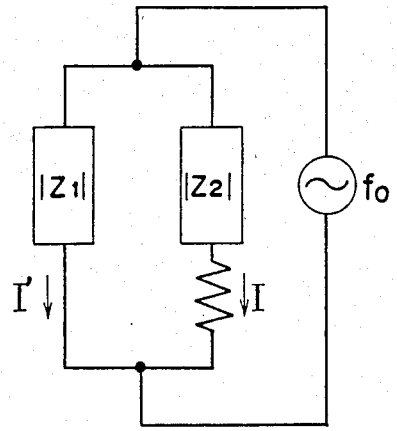
FIG. 8 is an equivalent circuit diagram for describing the amount of the ringing current when the ringing current flows into the primary winding and the ringing removing winding.

The impedance on the curve 2 with respect to the series resonance frequency f0 of the curve 1 is |Z1|. Also, the impedance on the curve 3 with respect to the series resonance frequency f0 of the curve 1 is |Z2|. An equivalent circuit of the ringing current loop is shown like FIG. 8, the size of the ringing current I' flowing into the primary winding 61 and the ringing current I flowing into the ringing removing winding 111 is determined by a ratio of |Z1|, |Z2| shown respectively by the curves 2, 3 in the series resonance frequency f0 of the curve 1.

In order to flow the ringing current to the ringing removing winding 111, but not to flow it into the primary winding 61, the series resonance frequency f1 shown by the curve 2 is required to go in the left direction on, for example, FIG. 7 to get it far away from the series resonance frequency f0 of the curve 1, and the series resonance frequency f2 shown by the curve 3 is required to go in the right direction on, for example, FIG. 7 to get it close to the series resonance frequency f0 of the curve 1. Therefore, the impedance |Z1| becomes larger, the impedance |Z2| becomes less. In the impedance relation like this, the ringing current does not flow much into the primary winding 61, but flows mainly into the ringing removing winding 111. The ringing current I which is adapted to flow into the ringing removing winding 111 is damped quickly by the resistance element 12, thus removing the above-described problems caused by the ringing 10.

Figure 4:
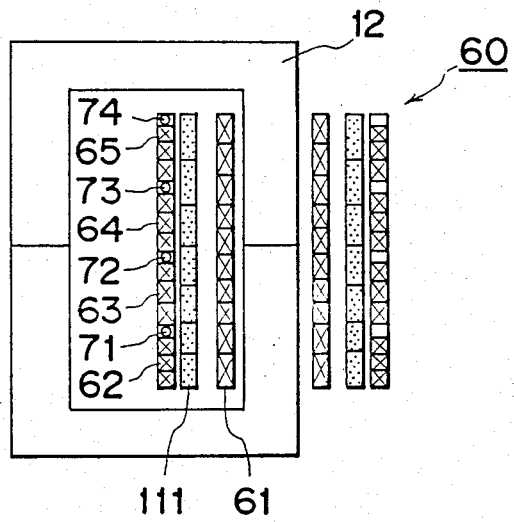
FIG. 4 is a schematic construction view of a transformer in the embodiment of the present invention.

FIG. 4 is a perspective construction view of a fly-back transformer 60 in this embodiment. In FIG. 4, a closed magnetic circuit core 12 is composed of a pair of -shaped cores butted, a primary winding 61 is wound around the closed magnetic circuit core 12 through a low voltage bobbin (not shown), a ringing removing winding 111 is wound above the primary winding 61 in a given interval with respect to the primary winding, secondary windings 62, 63, 64 and 65 are secondary windings wound on the ringing removing winding 111 through a split-type high-tension bobbin (not shown), diodes 71, 72, 73 and 74 are alternately connected with the secondary windings 62, 63, 64 and 65. The ringing removing winding 111 may be wound directly around the low-tension bobbin of the primary winding 61 (not shown) through an insulating spacer of given thickness or may be wound around the different bobbin from the low-tension bobbin.

The fly-back transformer of such construction as described hereinabove is free from the conventional problems which are caused by the ringing, but the ringing removing winding 111 is required to be kept too away from the primary winding 61 to satisfy the given conditions which are necessary to make the ringing smaller. Therefore, the fly-back transformer becomes larger in size and the distances between the primary winding 61 and the secondary windings 62, 63, 64 and 65 become farther so that the high-tension regulation becomes unfavorably worse.

Figure 5:
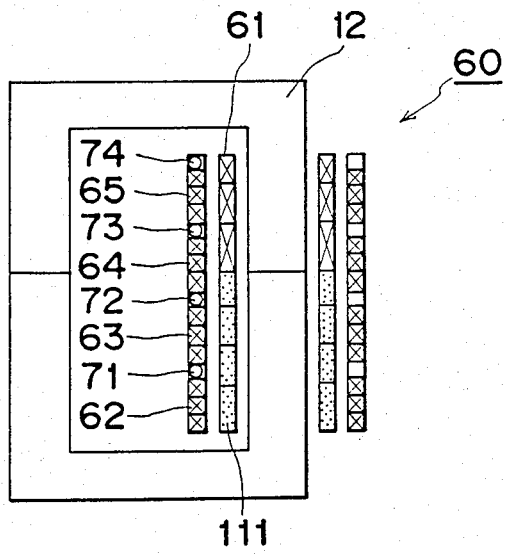
FIG. 5 is a schematic construction view of another modified example of the fly-back transformer in this embodiment.

FIG. 5 is a schematic construction view of a fly-back transformer 60 in the preferable embodiment of the present invention. What is worth notice in the fly-back transformer 60 of FIG. 5 is that the primary winding 61 and the ringing removing winding 111 are respectively wound in parallel around the same low-tension bobbin (not shown), to be located on the side of the secondary winding 65 which is the side of high potential, on the side of the secondary winding 62 which is the side of low potential. Because of the construction of the winding, the secondary windings 62, 63 and the one portion of the secondary winding 64 which are opposite to the ringing removing winding 111 among the secondary windings 62, 63, 64 and 65 satisfy the requirements of the present invention which are necessary to make the ringing smaller. One portion of the secondary winding 64 and the secondary winding 65 which are not opposite to the ringing removing winding 111 do not satisfy the requirements of the present invention for making the ringing smaller. Accordingly, the ringing becomes smaller in at least the secondary windings 62, 63, but the ringing does not become smaller in the secondary winding 65. Although the ringing is large in the secondary winding 62 connected with an earth potential and the secondary winding close to it, from among the respective secondary windings, the ringing is originally not large in the secondary windings except for the above-described windings. The entire flyback transformer is influenced by windings of large ringing such as secondary winding 62, etc. Accordingly, the windings of the large ringing such as secondary winding 62, etc. are made smaller in ringing so that the ringing becomes considerably smaller in the entire fly-back transformer.

Figure 6:
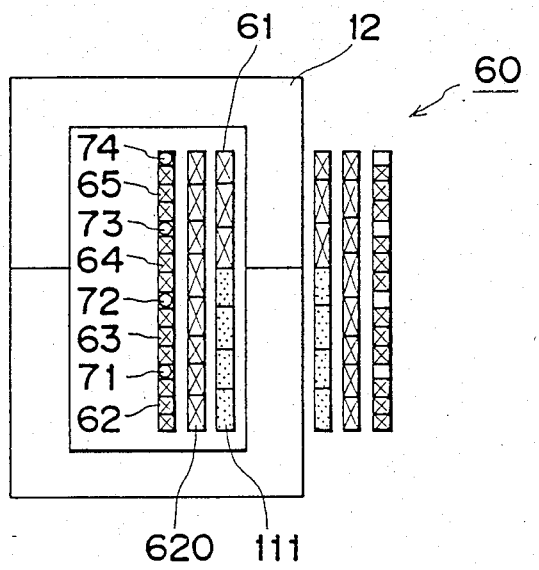
FIG. 6 is a schematic construction view of still another modified example of the fly-back transformer in this embodiment.

FIG. 6 is a schematic construction view showing a fly-back transformer in a further preferable embodiment of the present invention. What is worth notice in the fly-back transformer 60 of FIG. 6 is that the primary winding 61 is wound around the low-tension bobbin as the ringing removing winding 111 is wound around it as shown in FIG. 5, and one portion 620 of the secondary winding 62 is located between the primary winding 61, the ringing removing winding 111 and the secondary windings 62, 63, 64 and 65. Because of this construction, the combination with the primary winding 61 of the secondary winding 62 becomes larger so that the ringing may be made smaller than the fly-back transformer of FIG. 5.

The winding width of the secondary winding 62 is made longer as in FIG. 6 so that the distributed capacity between the side of the wind-beginning end of the secondary winding 62 and the side of the wind-beginning end of the ringing removing winding 111 may be reduced, and the ringing current flowing into the ringing removing winding 111 may be efficiently flowed into a resistance element 112. The same thing can be said about the cases of FIG. 4 and FIG. 5. The winding width of the secondary winding 62 is required to be made longer in the axial direction of the bobbin.

It is generally known that the critical damping resistance value Rs of the resistance 112 connected with the ringing removing winding 111 is proportional to the square root of the leakage inductance, but is inversely proportional to the square root value of the distributed capacity. The critical damping resistance value Rs is desired to become as small as possible because the high-tension regulation becomes worse, if it becomes larger, to lose the significance of having the ringing removing winding 111 disposed. Accordingly, in order to make the critical damping resistance value Rs smaller, the leakage inductance is required to be rendered smaller or the distributed capacity is required to be rendered larger. Even in any of the above-described embodiments, the winding width of the portion of 62 among the secondary windings 62, 63, 64 and 65 is made longer as described hereinabove to render the leakage inductance smaller, and the distributed capacity is made larger to render the critical damping resistance value Rs smaller.

It is to be noted that although the resistance element 112 was made the lower end of the ringing removing winding 111 in the above-described embodiment, it is not necessarily required to be limited to this position and may be located in the middle position of the ringing removing winding 111 if only it is located in a position where the ringing current may be sufficiently damped. Even in any of these cases, the resistance element 112 is required to be mounted on the bobbin around which the ringing removing winding 111 is to be wound. Also, in the above-described embodiment, a resistance element 112 as an individual part was connected with the ringing removing winding 111. But, in the other embodiment, the ringing removing winding 111 without provision of the resistance element 112 may be composed of resistance wire wound such as manganin wire, nichrome wire, Cu-Ni alloy or the like so that the ringing current may be damped by this resistance wire. In this case, only one portion of the ringing removing winding 111 may be made of the resistance wire.

Also, the side of the secondary winding in the above-described embodiment may have a diode connected onto the side of the earth terminal of, for example, the secondary winding 62. It can also be so arranged that the diode 74 on the side of the high-tension output terminal of the secondary winding 65 is eliminated. Or the secondary winding may be one in number without being divided into plurality by the diode.

Figure 9:
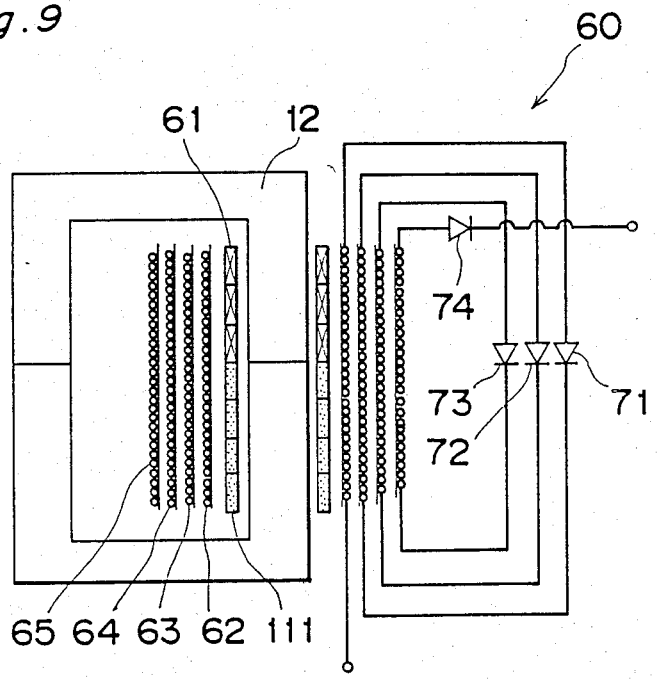
FIG. 9 is a schematic construction view of a fly-back transformer in a further embodiment of the present invention.

The fly-back transformer of the present invention may be of course applied even in not only the construction wherein such secondary winding and diode as in the above-described embodiment are adapted to be alternately disposed in the axial direction of the bobbin when the side of the secondary winding is composed of a plurality of diodes, but also the construction wherein a plurality of secondary windings are sequentially piled up in the diametral direction. FIG. 9 shows a fly-back transformer, wherein a plurality of secondary windings like this are piled up in the diametral direction.

According to the present invention as described hereinabove, the ringing removing wire which is connected with the secondary winding through the distributed capacity with respect to the secondary winding to form a closed circuit of the ringing current together with the secondary winding is connected in parallel to the primary winding through the DC resistance component, so that the ringing may be damped by the closed circuit. In this case, the primary winding and the ringing removing winding satisfies a relation formula of $0.85 \leqq M/L1 \leqq 1$, wherein L1 is the inductance of the primary winding, M is the mutual inductance between the primary winding and the ringing removing winding. Thus, most of the basic pulse current to be inputted into the primary winding may flow through the primary winding, so that the loss of the basic pulse current in the ringing removing winding may be made as small as possible.

Furthermore, as the impedance between the primary winding and the secondary winding has a value larger with respect to the frequency of the ringing current than a value of the DC resistance component added to the impedance between the ringing removing winding and the secondary winding, the ringing current is adapted to flow on the side of the ringing removing winding so that the ringing current which is made to flow on the side of the ringing removing winding is effectively damped by the DC resistance component.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A fly-back transformer wherein a primary winding and a secondary winding are provided, a ringing removing winding which is connected with the secondary winding through the distributed capacity with respect to the secondary winding to form a closed circuit of the ringing current together with said secondary winding is connected in parallel to said primary winding through a DC resistance component, said primary winding and said ringing removing winding satisfy a relation formula of $0.85 \leqq M/L1 \leqq 1$, wherein L1 is the inductance of the primary winding, M is the mutual inductance between the primary winding and the ringing removing winding, the impedance between said primary winding and the secondary winding has a value larger with respect to the frequency of the ringing current than a value of the DC resistance component added to the impedance between the ringing removing winding and the secondary winding.

2. A fly-back transformer as claimed in claim 1, wherein said closed circuit includes a resistance element as the DC resistance component.

3. A fly-back transformer as claimed in claim 1, wherein said ringing removing winding is at least partially constituted by a resistance wire and the resistance value of said resistance wire acts as said DC resistance component.

* * * * *